US006352031B1

(12) United States Patent
Barbaccia

(10) Patent No.: US 6,352,031 B1
(45) Date of Patent: Mar. 5, 2002

(54) RADIATIVE COUNTERMEASURES METHOD

(75) Inventor: Philip L. Barbaccia, Farmingdale, NY (US)

(73) Assignee: Northrop Grumman Corporation, Los Angeles, CA (US)

( * ) Notice: Subject to any disclaimer, the term of this patent is extended or adjusted under 35 U.S.C. 154(b) by 0 days.

(21) Appl. No.: 05/281,815

(22) Filed: Aug. 18, 1972

(51) Int. Cl.[7] ..... F42B 12/00; H01Q 17/00

(52) U.S. Cl. ..... 102/365; 102/336; 102/363; 342/3

(58) Field of Search ..... 244/3.16; 102/34.4, 102/35.2, 35.6, 336, 363, 365; 89/1 A; 342/3; 44/7; 431/3, 91

(56) References Cited

U.S. PATENT DOCUMENTS

| | | | | | |
|---|---|---|---|---|---|
| 2,669,437 A | * | 2/1954 | Geeraert | ..... | 44/7 A |
| 2,971,573 A | * | 2/1961 | Griffin et al. | ..... | 431/91 |
| 3,150,848 A | * | 9/1964 | Lager | ..... | 244/3.16 |
| 3,154,041 A | * | 10/1964 | McKinnon | ..... | 60/240 |
| 3,258,917 A | * | 7/1966 | Sargent et al. | ..... | 60/217 |
| 3,355,269 A | * | 11/1967 | Winkler | ..... | 44/7 C |
| 3,639,258 A | * | 2/1972 | Corino et al. | ..... | 44/7 C |

* cited by examiner

*Primary Examiner*—Peter A. Nelson
(74) *Attorney, Agent, or Firm*—Terry J. Anderson; Karl J. Hoch, Jr.

(57) ABSTRACT

A method for creating coherent masses of burning matter for countermeasures purposes such as for protecting an aircraft and other vehicles from infrared "heat seeking" hostile missiles and also from high power Laser beams and Laser radar. One or more spurious sources of radiation are created controllably in the general vicinity of the aircraft being protected; in missile countermeasures, each of these spurious sources is capable of emitting infrared energy comparable in wave length and at a higher intensity than that emitted by the target aircraft itself such that the hostile missile will be decoyed away from its intended target by the spurious radiation sources. In this method, the spurious source of radiation is created by igniting a small amount of aircraft fuel that is gelled and controllably ejected from the aircraft. Protection against Laser weapons and radar is provided by interposing the burning mass of matter in the Laser beam so that combusion products in the burning mass serve to degrade beam power. Apparatus for practicing the method is disclosed comprising means for withdrawing a small quantity of fuel from the aircraft fuel tank, means for adding a gelling agent to the quantity of fuel, and means for simultaneously igniting and ejecting the quantity of gelled fuel such that a persistent source of radiant energy that can be used for decoy purposes and attenuating Laser beams is produced.

8 Claims, 2 Drawing Sheets

FIG. 1
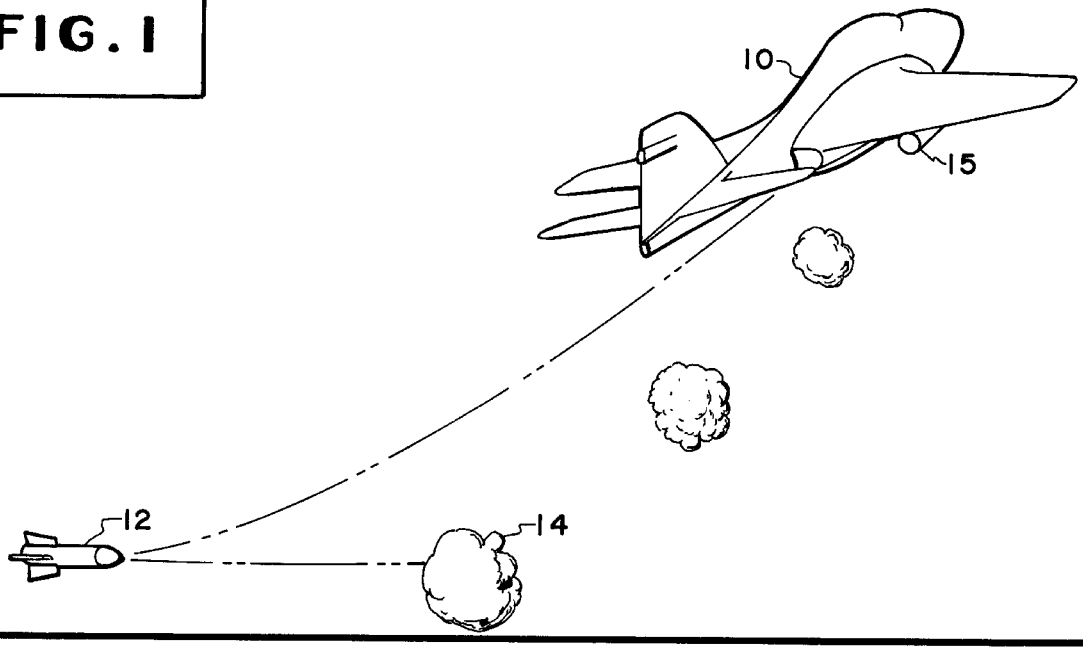
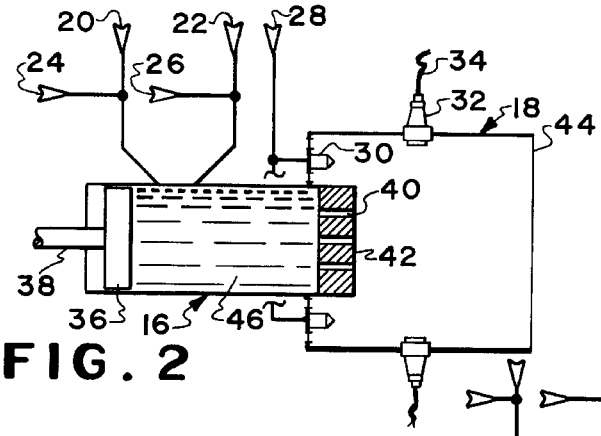
FIG. 2
FIG. 3
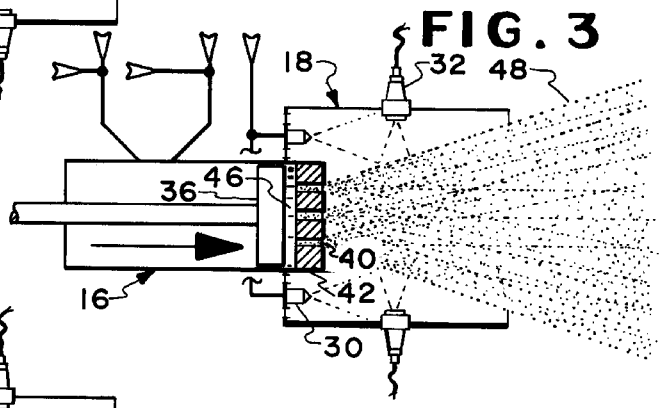
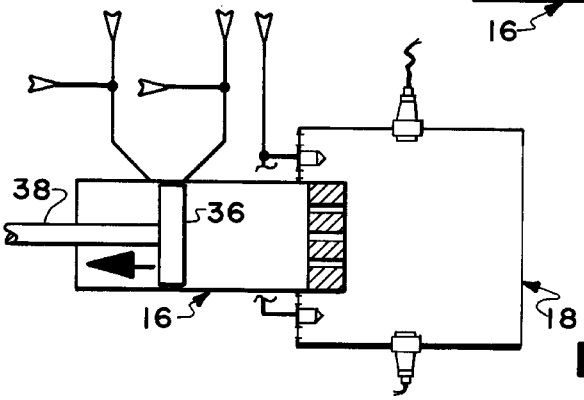
FIG. 4

RADIATIVE COUNTERMEASURES METHOD

BACKGROUND OF THE INVENTION

1. Field of the Invention

The present invention relates to countermeasures and more, particularly, to a method and apparatus for creating coherent sources of radiation that can be used for decoying hostile missiles of the infrared "heat-seeker" type away from the target vehicle being protected and for attenuating Laser beams directed at the vehicle.

2. Description of the Prior Art

It is increasingly common practice in missile operations to provide guidance means on the missile itself to enable it to "home-in" on its target. A number of types of missiles are presently designed to incorporate means which enable them to "seek-out" a particular moving target by homing-in on the infrared energy emitted by latter. Missiles of this type are effective against targets such as aircraft and surface vehicles which emit various amounts of infrared radiation from their propulsion systems.

A number of techniques have been proposed to protect the target vehicle against heat-seeking missile threat. These include: electronic jammers, suppressants, shields, and blocking devices, pyrophorics, and flares.

The typical electronic jammer is designed to emit signals at frequencies which will adversely affect the processing of guidance intelligence in the IR missile seeker. For the system to be effective, however, the processing mechanism of the IR seeker must be known and the missile processing frequencies must be fairly uniform; thus electronic jamming has obvious disadvantages.

Suppressants are additives either injected into the hot exhaust gases or introduced between the gases and the oncoming IR seeking missile. Because of the large quantities of additives required to achieve any significant IR emission reduction and because of other drawbacks, the technique has limited capabilities and is considered to be impractical.

Properly designed and installed shields and blocking devices used to screen the IR emissions of the target vehicle from the heat-seeking guidance means can increase vehicle survivability but pose a weight and drag penalty on the vehicle. Lack of protection against certain types of "plume-seeking" missiles and the possibility that the shielding obtained is above the missile lock-on level are other major disadvantages.

Pyrophorics have been used to produce a fireball near the target vehicle to thereby decoy a hostile missile away from its intended target. Pyrophorics, such as triethylaluminum, mixed with jet fuel result in mixtures having a high hydrocarbon content such that the flame for decoy purposes has a substantial IR output in the spectral range of interest. Because pyrophorics are highly reactive, an ignition system probably will not be required within certain aircraft altitude and velocity limits. However, the high reactivity of pyrophorics makes them hazardous to handle and store aboard the vehicle. The technique also introduces weight and cost penalties.

Flares ejected from the target with an object of decoying a hostile missile have been extensively utilized for IR countermeasures because even a two-pound unit can provide up to 10-seconds protection against IR-seeking missiles. In as much, however, as the typical flare presently used burns a magnesium-teflon powder whose relative IR intensity is more pronounced in the lower wave-lengths, it is possible to fit the seeker with filter means such that the missile discriminates against the flare-predominant wavelengths and homes in on the wave-lengths produced by the vehicle propulsion combustion-products.

In the prior art, also, S. E. Lager, U.S. Pat. No. 3,150,848, discloses a method for decoying a missile from its intended target, which method employs a pyrophoric in the phyrophorics countermeasures technique disclosed above except that an oxidizer is used instead of jet fuel in the mixture ejected from the target. Inasmuch as Lager uses, in his method, a typical pyrophoric which is capable of spontaneous ignition when exposed to air, the technique disclosed is open to question with respect to safety in handling, storage and use.

Also disclosed in the prior art by G. W. Goddard, U.S. Pat. No. 2,895,393, is a system for igniting the fuses of flares dropped into the exhause nozzle of a jet or rocket propelled aircraft and ejecting the flares therefrom such that, after suitable delay, the flares are "exploded" to emit radiant energy. Although the system of Goddard is intended to provide illumination in an aerial photography system rather than to act as a countermeasures means against hostile missiles, Goddard is of interest as disclosing an example of the dispersion of flares from an aircraft.

SUMMARY OF THE INVENTION

The subject invention comprises a method and apparatus for use therewith for creating coherent sources of radiation that can be used for various purposes such as for-protecting aircraft and other vehicles from hostile missiles equipped with guidance systems of the infrared heat-seeking type and from high-power Laser beams and Laser radar. In the method, a number of sources of radiation are dispersed controllably from the target vehicle, for missile countermeasures, each of the sources is capable of emitting infrared energy comparable in wave length and intensity to that radiated by the target vehicle itself such that the hostile missile will be decoyed away from its intended target by the spurious radiation sources. For Laser countermeasures, the coherent sources of radiation are interposed in the path of the Laser beam such that the effectiveness of the beam is degraded by combustion products in the radiation sources. The radiation sources of this method are produced by the target vehicle by withdrawing a small quantity of fuel from the fuel tank, adding a gelling agent to the "charge" of fuel such as to create a fuel gel and thereby add to the coherence of the charge, and then simultaneously igniting and ejecting the charge in the form of a ball of flame with extended burn time.

In all the prior art decoy-type countermeasures using a spurious radiation source technique related to that of the subject invention, there is a requirement for the vehicle being protected to carry either a quantity of pyrophoric materials or a number of flares. Further, the quantity of pyrophoric or the number of flares is dependent on the nature and duration of the vehicle mission. It will be seen, therefore, that the vehicle is loaded with countermeasures equipment and stores for a particular number of decoy operations and the weight penalty for the mission is fixed even if there is no requirement for decoy operation during the mission. Thus, when the vehicle is not exposed to a missile threat during a mission the full weight of the unused pyrophoric or flare-type countermeasures stores as well as the equipment for dispensing the stores represent a cost and performance penalty on the vehicle. In the subject method, however, the spurious radiation produced for decoy purposes is generated by the burning of a mixture composed of a small quantity of fuel from the vehicle's tank and a gelling agent. The penalty on the vehicle is the weight of the equipment used to form, ignite, and eject the burning mixture and of the gelling agent, since the fuel set aside for decoy operations, if not expended, can be used to extend the flight time of the vehicle or to enhance its reserve factor. Inasmuch as only about five percent by weight of gelling agent is used with a one-pound charge of fuel, the payload weight penalty for the countermeasures equipment and stores is less by a factor of 3 or 4 than the prior art IR decoy techniques.

The fireballs produced in this countermeasures method can also be used by both airborne and surface vehicles for protection against high-power Laser weapons and Laser radars. The burning fuel gell particles and other combustion products of the fireballs when interposed in a Laser beam create a variety of beam degradation effects. With fuels usually used, the major, products of combustion such as $CO_2$ and $H_2O$ have a high attenuation on Laser beams of particular wavelengths of interest, particularly 10.6 microns. Since complete combustion of the fuel gel generally does not occur, a variety of intermediate products, as well as carbon particles, will be formed. Laser beam scattering effects will be produced by the carbon particles, which will occur in a variety of sizes. Intermediate products created will have an absorption effect on Laser beams at various wavelengths. For example, an intermediate product created when gelled jet fuel is burned is ethylene which is a high absorber of the 10.6 micron wavelength of a Laser beam.

The present invention thus provides a radiation-type countermeasures method in which fuel from the vehicle being protected instead of extraneous pyrophoric material or flares is used to generate countermeasures radiation such that the cost and performance penalty on the vehicle is minimized.

It is a further object of this invention to provide a radiation decoy-type countermeasures system substantially not requiring the use of pyrophoric materials or flares such that the hazards associated therewith during storage, handling, and operation are substantially eliminated.

It is another object of this invention to provide a radiation-decoy type countermeasures in which the bandwidth of IR emissions from the decoy radiation simulates closely the bandwidth or IR "signature" of the vehicle engine and in which said decoy radiation is of a substantially higher intensity to enhance the successful decoying of the hostile missile.

DESCRIPTION OF THE DRAWINGS

For the purpose of illustrating the invention, there is shown in the drawings the forms which are presently preferred, it being understood, however, that this invention is not necessarily limited to the precise arrangements and instrumentalities here shown.

FIG. 1 is a diagrammatic view of the decoy-type missile countermeasures system in accordance with the invention showing it in the environment of use;

FIGS. 2, 3, and 4, are schematic views of apparatus in accordance with the invention during various stages in its operational cycle.

DESCRIPTION OF THE PREFERRED EMBODIMENTS

Figure 5:
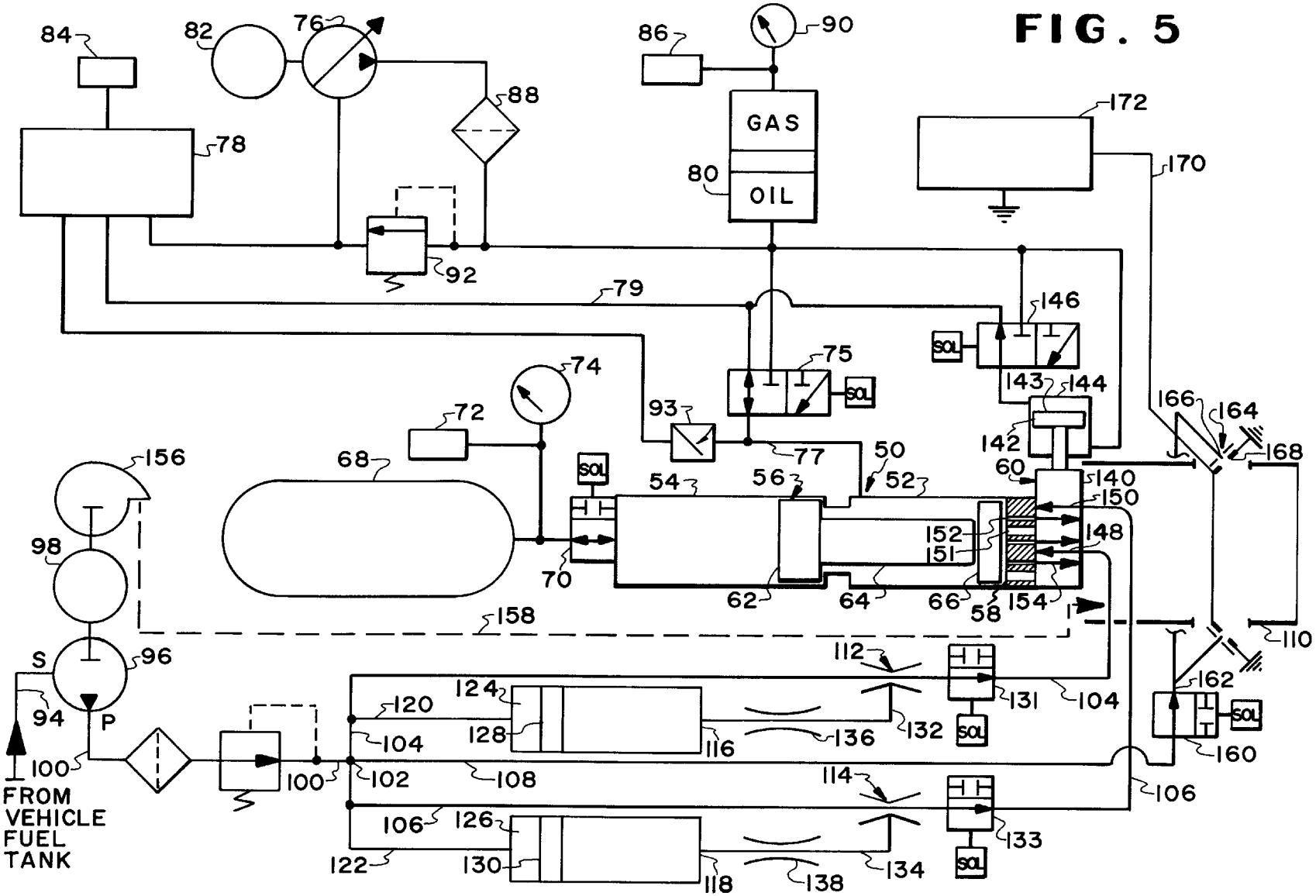
FIG. 5 is a schematic view of an embodiment of apparatus for producing radiant decoy-type missile countermeasures in accordance with the invention.

The fireballs produced by the method of this invention can be used for various countermeasures purposes, such as for protecting a vehicle against Laser weapons and Laser radars as set forth previously; however, to avoid unnecessarily complicating the explanation of the invention, the emphasis in this specification will be placed almost exclusively on decoy-type missile countermeasures, but this is not intended to limit the invention thereto.

Referring now to FIG. 1 of the drawings, an airborne vehicle such as an aircraft is designated by reference numeral 10. In this specification, the vehicle being protected by the decoy method will be set forth as a jet aircraft but it will be appreciated that any infrared-emitting vehicle, including propeller-driven aircraft and helicopters as well as land and water vehicles that are targets of heat-seeking, homing missiles may suitably be protected by the countermeasures means of this invention. Aircraft 10 is powered by a jet engine or other propulsion system the propulsion process of which emits a detectable percentage of infrared radiation. Also shown in FIG. 1, is a missile 12 of the IR target-seeking type which has been launched for the purpose of destroying the aircraft 10 either by impact or by exploding when it has reached a position proximate thereto. Missile 12 consequently incorporates an infrared detector and an associated guidance system (not shown) which permits the missile to locate and follow the target aircraft 10 by detecting radiant energy emanating from the aircraft's propulsion system. Under normal circumstances, it is unlikely that the evasive actions taken by the target aircraft will enable it to avoid being destroyed by the missile, since the trajectory of the missile is caused to change to counter changes in the direction of aircraft flight.

In accordance with a feature of the present invention, it is contemplated that the aircraft 10 when imperiled will emit or dispense at periodic intervals a discrete mass or quantum of radiant substance in the general form of a "puff" or fireball 14. Several of the masses are shown in FIG. 1, although it will be understood that the relative size and spacing of these emitted quanta are distorted in the drawing in order that the invention may be understood more readily. Also, although the emitted quanta will be referred to herein as a "fireball", the term is used as a matter of convenience since the design of the apparatus or other factors may result in the production of an emitted radiant mass having other than a spherical configuration. These decoy fireballs 14 are emitted from apparatus carried by the aircraft 10 in a wing or fuselage installation or exteriorly thereof such as, for example, in a suitable "pod" 15 attached to the aircraft as is well known and in common practice.

As briefly described previously, the spurious radiation source or fireball 14 is produced by withdrawing a small quantity of fuel from the vehicle's fuel tanks, adding a gelling agent to the quantity of fuel, and simultaneously igniting and ejecting the gelled burning fuel to thereby form the fireball used to decoy the hostile missile. It will be appreciated that the apparatus used to gel the fuel and thereafter ignite and eject it in accordance with the method of this invention can be of any suitable design to suit the vehicle to be protected, environment of use, and type of fuel and gelling agent employed. For example, the apparatus may comprise a fuel-gel mixing and expulsion chamber 16 and an ignition chamber 18 as shown in FIG. 2. Fuel from the vehicle fuel tanks (not shown) is pumped through feedlines 20 and 22 by suitable means (not shown) into chamber 16. Connected into feedlines 20 and 22 upstream of chamber 16 are chemical gelling agent additive feedlines 24 and 26 from suitable reservoirs and metering means (not shown). The chemical additives for gelling the fuel can be of any appropriate type that will impart the required thickness and other characteristics to the fuel: With JP-5 aviation jet fuel, for example, feedline 24 can meter cocoamine into fuel feedline 20, and feedline 26 can meter toluene di-isocyanate into fuel feedline 22. Fuel gels of suitable thickness can be obtained using these additives in combined concentrations ranging from 2% to 10% by weight of the jet fuel charge; preferably, however, with a 0.95-lb. charge of fuel, a combined weight of 0.05-lb. of additives is used. The quantity of fuel gel used per operation can be varied to suit the requirements. The quantity used will be "tailored" to the particular vehicle being protected and will be determined by the maximum IR output of the vehicle. It will be appreciated that the higher the IR output of the vehicle, the larger quantity of fuel gel charge per operation will be required. For example, a one-pound charge of fuel gel per operation is considered sufficient to produce an IR output sufficient to protect an aircraft such as the Navy/Grumman A6 powered with J-52 jet engines. A cocoamine/toluene di-isocyanate gelling combination is preferred, however, it will be noted that other-fuel gel systems, such as the polymerization of vinyl ether, be suitable for the fuel being gelled. A converging direction of entry is employed for feedlines 20 and 22 so that the separate streams of additive-impregnated fuel pumped into chamber 16 impinge to promote a thorough mixing that will encourage the chemical reaction of the additives in the two streams so as to insure a formation of a uniform fuel gel in the shortest possible time.

For ignition, a small quantity of fuel is pumped from the vehicle fuel tanks through fuel feedline 28 and is introduced through a multiplicity of fuel atomizing nozzles 30 into the ignition chamber 18. This spray of atomized fuel is ignited by appropriate means such as by glow plugs 32 connected by ignition wiring 34 to a suitable ignition system (not shown) to thereby produce a pilot flame in the ignition chamber. A piston 36 driven by a suitable actuator (not shown) by means of piston rod 38 is used to force the gelled fuel out of chamber 16 through a multiplicity of metering apertures 40 in aperture plate 42 opening into the ignition chamber, thereby forming a mass of particles. Sufficient force is applied by the actuating piston on the charge of gelled fuel so that its momentum carries it through the ignition chamber. The mass of particles passing through the ignition chamber is ignited by the pilot flame therein and the burning mass has sufficient momentum to be projected out of the discharge end 44 of the ignition chamber and away from the aircraft. The size, configuration, and distribution of the apertures 40 in plate 42 are such that the gelled fuel charge is broken up into particles of various sizes, the range of particle sizes being selected to insure the required burn time of the resultant fireball. In addition to the aperture plate, the piston pressure and rate, and the rheological properties of the gelled fuel are factors governing the particle size. Purging means (not shown) can be provided if required in chamber 18 to purge it with air or other suitable fluid after the ignition of the gelled fuel passing therethrough to guard against residual burning in the chamber.

It will be understood that control means are to be provided in the vehicles being protected by this countermeasures system to initiate the gelling, ejection and ignition of the gelled fuel that will produce the fireball decoy and to effectuate the various operations involved in the process. To be most effective, the system should have two modes: the production of a single fireball on command; and a continuous mode. The controller used should have the capability for controlling on command the various sequences of operations in the system for the production of fireball decoys in the two system modes. Controllers that can be successfully utilized in the countermeasures system of this invention are in common use in military aircraft and other vehicles to dispense on command various ordnance devices and stores, including flare-type radiant decoy countermeasures. In the interests of brevity, therefore, a description of the controller and associated equipment used with the apparatus of this invention will not be given, it being understood that any suitable control means in common use can be utilized.

In carrying out the method of this invention, decoy fireballs can be deployed in a continuous mode when the aircraft flies over known missile-defended areas. A second technique is to employ a missile-warning system and initiate the deployment of a series of decoys when the system detects launched missiles. The aircraft will be operated with a "ready" charge in chamber 16 (FIG. 2). When the warning system detects missile launch, the operational sequence is initiated with the expulsion and ignition of the "ready" charge (FIG. 3). The production of a subsequent fireball is initiated when a second charge of fuel is pumped from the fuel tanks to the fuel-gel mixing and expulsion chamber 16 by means of feedlines 20 and 22. As the charge of fuel flows to chamber 16, a metered quantity of cocoamine from line 24 is injected into the flow in line 20 and a metered quantity of toluene di-isocyanate from line 26 is injected into the flow in line 22. The flow from the two separate feedlines, impregnated with the respective additives are introduced simultaneously into the chamber with the two streams impinging to insure thorough mixing. The chemical reaction between the two gelling additives gels 46 the fuel at a rate dependent upon the characteristics of the fuel and the additives. At the completion of the fuel gelling procedure, a small flow of jet fuel from the fuel tanks is pumped through feedline 28 and is sprayed through fuel atomizing nozzles 30 into ignition chamber 18 where the atomized spray is ignited by glow plugs 32. Piston 36 is then actuated, forcing the fuel gel 46 through the apertures 40 to thereby break it up into a spray 48 of gelled fuel particles which have been given the required momentum to carry them through the ignition chamber and to project them the required distance from the aircraft as a coherent cloud or mass of particles which have been ignited as they passed through the burning atomized fuel spray in the ignition chamber. Upon completion of the piston stroke and the ignition and expulsion of the mass of fuel gel particles forming the fireball, the flow of fuel to atomizing nozzles 30 is shut off and the ignition chamber 18 can be purged to guard against residual burning. The piston is then repositioned (FIG. 4) in readiness for the next cycle.

In the above sequence of operation of the fuel gelling, expulsion, and ignition cycle for producing a decoy fireball, a diagrammatic showing of apparatus that can be used in the method of the invention is illustrated in FIGS. 2–4, so that the explanation of the operation is not needlessly complicated by unnecessary detail. It will be appreciated that any appropriate arrangement of equipment that will gel a quantity of fuel and will then dispense that gelled fuel from the aircraft as a fireball in accordance with the invention can be used. It will also be appreciated that the ancillary equipment used with the fuel gelling, expulsion, and ignition means can take various forms such as, for example, the preferred embodiment of FIG. 5.

As shown in FIG. 5, the system has a-fuel gel expulsion subsystem 50 comprising a fuel gel chamber 52, a piston chamber 54, a piston assembly 56, a nozzle 58, and a valve plate assembly 60. Piston assembly 56 has a power piston 62 having an integral ram 64 which transmits piston thrust to a separate fuel gel piston 66. Fuel gel piston 66 operates in gel chamber 52 and is acted upon but is not attached to piston ram 64. Actuation of power piston 62 is by means of high pressure air stored in an air bottle 68 feeding through a solenoid-actuated valve 70. Air bottle 68 is provided with a conventional fill valve 72 and an air gage 74 and has suitably a 100 cubic inch capacity and is charged to 600 psi. In the design embodied in FIG. 5 the work done to actuate the power piston 62 during the expulsion cycle produces a drop in air bottle pressure, but the pressure is restored to its normal level when the power piston is "re-cocked", as will be explained in greater detail, by hydraulic means.

In the FIG. 5 embodiment, a hydraulic system having a solenoid-operated valve 75 is utilized to re-cock or re-position the power piston 62 into its ready position, and also to power the re-charging of the air bottle to its ready level. The hydraulic system comprises a hydraulic pump 76, a reservoir 78, and an accumulator 80. Pump 76 is driven by suitable mean, such as an electric motor 823 and it acts to keep the hydraulic accumulator 80 re-charged, when required, during system operation. It will be recognized that an accumulator is not essential for operation, but its incorporation into the design reduces the size and power requirements of the hydraulic pump. By way of example, useable design parameters for the hydraulic system are a peak. rating for the pump of 1.9 gallons per minute at 1500 psi pressure and a 100-cubic inch volume accumulator at a recharge pressure of approximately 670 psi. The components of the hydraulic system can be of any appropriate type in common use and the system can be fitted with the usual auxiliary equipment such as fill valves 84 and 86 for the reservoir and accumulator respectively, a filter 88, pressure gage 90, pressure relief valve 92, and a check valve 93, and the like.

Fuel used for the production of the fireball decoys is drawn from the aircraft fuel tanks (not shown) through line 94 by fuel pump 96 which is driven by suitable means such as electric motor 98. In a system designed to produce approximately one pound of fuel gel per decoy operation and operating with a 5-second cycle time, the pump typically can be sized to deliver 5 gallons of fuel per minute at a pressure of 50 psi. Fuel is pumped through line 100 to junction 102 and divides therefrom into three feedlines: in the system of this embodiment, in addition to its use as the material burned to produce the fireball decoys, the aircraft fuel is also used for the ignition of the fireball in an ignition chamber. Thus, fuel is pumped through feedlines 104 and 106 to the fuel gel chamber 52 and also through feedline 108 to the ignition chamber 110.

The fuel pumped through feedline 104 to the fuel gel chamber 52 is passed through an additive metering means 112 where it is impregnated with a gelling agent; fuel pumped through feedline 106 to the fuel gel chamber 52 is passed through an additive metering means 114 where it is impregnated with a second gelling agent. It will be appreciated that the number and type of additives used to produce fuel gelling can vary widely to suit the requirements of the system design and the environment of use. In this embodiment, a cocoamine/toluene di-isocyanate system is preferred and these additives are contained in cylindrical tanks 116 and 118 respectively. The additive metering means is of a known venturi type in which the line pressure of the fuel being impregnated is used both to dispense and meter the additive. Thus, pressurized fuel from feedlines 104 and 106 is passed through lines 120 and 122 to the pressure sides 124 and 126 of free pistons 128 and 130 in additive tanks 116 and 118, respectively. Line pressure from the feedlines acts against free pistons 128 and 130 to force the gelling agents out of their tanks through lines 132 and 134 to venturi-type metering means 112 and 114 which meter the required quantity of cocoamine into the fuel flowing through feedline 104 and the required amount of toluene di-isocyanate into the fuel in feedline 106. if required, appropriate solenoid-operated shut-off valves 131 and 133 can be fitted in the feed-lines and flow regulators 136 and 138 of any suitable type can be provided in lines 132 and 134.

Flow of the additive-impregnated fuel into fuel gel chamber 52 is controlled by valve plate assembly 60 operating at the nozzle 58 end of the expulsion subsystem 50. Valve assembly 60 comprises a slide valve plate 140 which is operated by a piston 142 in hydraulic cylinder 144 controlled by a solenoid-actuated valve 146. Valve plate 140 has two operating positions: a loading position and an expulsion position. In the loading position, patterns of apertures 148 and 150 in the valve plate align feedlines 104 and 106, respectively, with loading apertures 151 in nozzle 58 such that streams of additive-impregnated fuel flow into fuel gel chamber 52. As noted previously, preferably, the aperture alignment is such that there is an impingement of the streams so that a thorough mixing of the additives is promoted to thereby insure that the fuel is gelled rapidly. In the expulsion position, patterns of apertures 154 in the valve plate align with discharge apertures 152 of the nozzle such that gelled fuel can be expelled from chamber 52.

Ignition of the spray of gelled fuel expelled from chamber 52 is by means of the ignition chamber 110. An air blower 156 driven by electric motor 98 provides a continuous supply of pressurized air through ducting 158 to the ignition chamber 110. This pressurized air is used in the ignition and combustion process and is also used to purge the ignition chamber after the fireball has been expelled. Fuel for the ignition and combustion process is supplied to the ignition chamber by feedline 108 and is controlled by a solenoid-operated on-off fuel valve 160. The outlet from valve 160 is connected by feedline 162 to a flame-holder assembly 164 comprising one or more oil-burner type spray nozzles 166 in the ignition chamber. The design of the flame-holder assembly and the fuel and air supply thereto can be of any appropriate type known in the art and, to avoid unduly complicating this description, further details thereof will not be given herein. In addition to an air and fuel supply, each flame-holder assembly is provided with an electrical spark igniter 168 which is connected by electrical wiring 170 into an ignition system 172 circuit.

In operation, the fuel pump 96, air blower 156, and, as required, the hydraulic pump 76, are activated to bring their respective systems to the operational level. In FIG. 5, the apparatus is represented at the end of the gelled fuel expulsion phase of its cycle. To ready the apparatus for the dispensing of fireball decoys, valve 75 is actuated such that fluid pressure through line 77 is directed against piston assembly 56 in chamber 52 thereby driving the piston assembly back to the air bottle end of the expulsion subsystem, cocking the power piston 62 with its integral ram 64. It will be noted that the separate fuel gel piston 66 will be held by hydraulic pressure against nozzle 58 during the cocking of the power piston. It will also be noted that the cocking of the power piston also drives the air from chamber 54 back into air bottle 68 and thus serves to re-pressurize the air bottle. High pressure air valve 70 is then closed. Valve 75 is set to reduce hydraulic pressure in the chamber 52 through return line 79 to reservoir 78. Valve 146 is then actuated such that hydraulic pressure on surface 143 of piston 142 causes it to move slide valve plate 140 of valve assembly 60 into the loading position in which apertures 148 and 150 align with nozzle loading apertures 151. The aligned apertures in this loading position allow additive-impregnated fuel from feedlines 104 and 106 to flow into fuel gel chamber 52, forcing back piston 66 to its cocked position in the process. When chamber 52 is loaded fully, valves 131 and 133 are actuated to shut off further flow through feedlines 104 and 106. Ignition fuel valve 160 is then actuated to initiate a flow of fuel to spray nozzles 166 of the flame holder assembly 164 and simultaneously the atomized fuel spraying out of the nozzles is ignited by electrical spark igniter 163 to introduce a pilot flame into ignition chamber 110. Production of a decoy fire-ball is initiated by triggering valve 146 of the slide valve and high pressure air valve 70. Actuation of valve 146 causes slide valve plate 140 to be moved into its expulsion position, aligning apertures 154 in the valve plate with discharge apertures 152 in the nozzle 58 such that the stroking of the piston assembly 56 under the impulse of compressed air from air bottle 68 produces a spray of gelled fuel particles out of chamber 52. Passage of the mass or cloud of sprayed particles through the pilot flame in the ignition chamber 110 ignites the mass which is projected by the momentum imparted to it by the piston assembly through the ignition chamber and into the open air clear of the air-craft where the fireball acts as a decoy against a missile threat. The system after deployment of the fireball is as represented in FIG. 5. After the mass of sprayed particles has been expelled, ignition fuel valve 160 is closed to cut off the flow of fuel to the spray nozzles in the ignition chamber, extinguishing the pilot flame. Air blower 156 continues to supply pressurized air through duct 158 to purge the ignition chamber of residual burning particles. This completes the cycle of operation, which cycle is repeated as required for the production of decoy fireballs.

Although shown and described in what is believed to be the most practical and preferred embodiments, it is apparent that departures from the specific method and apparatus described will suggest themselves to those skilled in the art and may be made without departing from the spirit and scope of the invention. I, therefore, do not wish to restrict myself to the particular methods illustrated and described, but desire to avail myself of all modifications that may fall within the scope of the appended claims.

Having thus described my invention, what I claim is:

1. The method for creating discrete coherent clouds of burning matter which can be utilized for military countermeasures purposes to protect aircraft and other vehicles against infrared heat-seeking hostile missiles and light-radiation devices such as high power Laser weapons, Laser radars, and the like, comprising the steps of:

withdrawing from the fuel tank of the vehicle a quantity of the fuel used in the propulsion means thereof;

passing said quantity of fuel to a dispenser associated with said vehicle;

gelling said quantity of fuel by the addition of a gelling agent;

passing said gelled fuel through a plurality of openings in an apertured plate to change said gelled fuel into a particulate form, said gelled fuel being passed through said apertures at a rate and pressure that will impart momentum sufficient to project the particles away from said dispenser such that said quantity of particulate gelled fuel is expelled from the vehicle in the form of a discrete cloud of particles; and igniting said cloud of particles in the dispenser prior to its expulsion from the vehicle to thereby produce a fireball comprising a source of radiation having wavelengths comparable to the radiation emitted by the vehicle propulsion means.

2. The method of claim 1 wherein the gelling agent comprises at least a first and a second substance.

3. The method of claim 2 wherein the first substance is a cocoamine and the second substance is toluene di-isocyanate.

4. The method of claim 1 wherein the fireball is used as countermeasures against light radiation devices and wherein said fireball is interposed between the vehicle being protected and the source of said radiation whereby the physical effects of the combustion of said fireball serve to attenuate said radiation.

5. The method of claim 1 wherein the fireball is used as countermeasures to protect a vehicle against infrared heat-seeking hostile missiles, said vehicle being propelled by propulsion means which radiates energy as a characteristic of its operation, wherein the principal constituent of the matter burned to produce the fireball is the fuel used by said propulsion means and having radiation wavelengths comparable to and an intensity greater than that of the radiation emitted by said propulsion means such that said missile is decoyed to seek out the spurious radiation of the fireball and thereby minimize the peril to said vehicle.

6. The method of claim 5 wherein the vehicle fuel used as the principal constituent of the matter burned to produce the spurious radiation comprises at least 75-percent by weight of said matter.

7. Apparatus for creating discrete coherent clouds of burning matter that can be used for military countermeasures purposes to protect a vehicle comprising:

a dispenser having a gelling chamber and an ignition area;

means for supplying to said gelling chamber a quantity of fuel withdrawn from the fuel tank of the propulsion means of said vehicle;

means for introducing a gelling agent into said quantity of fuel supplied to said gelling chamber whereby a charge of gelled fuel is produced in said gelling chamber;

means for establishing an ignition source in said ignition area;

aperture means having a plurality of openings associated with said gelling chamber; and means for applying a force on said charge of gelled fuel in said gelling chamber to force said charge through said aperture means, the rate and level of said force being high enough to produce a discrete spray of particles of gelled fuel directed with sufficient momentum to cars it through said ignition area and away from said dispenser and vehicle, said ignition source being established at the time of passage of said spray through said area whereby ignition of said spray is initiated to thereby produce a cloud of burning matter.

8. Apparatus for creating discrete coherent clouds of burning matter that can be used for military countermeasures purposes to protect a vehicle comprising:

a dispenser having a gelling chamber and an ignition chamber;

an aperture plate between said chambers, said plate being provided with a plurality of openings establishing fluid communication between said chambers;

means for supplying to said gelling chamber a quantity of fuel with-drawn from the fuel tank of said vehicle;

metering means for introducing selectively a gelling agent into said quantity of fuel supplied to said gelling chamber;

valve means intermediate said gelling and said ignition chambers, said valve means having a loading position and a discharge position, said valve means having a first and a second pattern of apertures, said first aperture pattern aligning said gelling chamber openings in said aperture plate with the fuel and gelling agent supply means to establish fluid communication therebetween when said valve is in said loading position such that fuel and gelling agent can be introduced into said gelling chamber to thereby produce a charge of gelled fuel, said second aperture pattern aligning said openings in said aperture plate between said gelling and said ignition chambers to establish fluid communication therebetween when said valve is in said discharge position;

means for passing a portion of said quantity of fuel from the vehicle fuel tank to spray nozzle means associated with said ignition chamber whereby a spray of ignition fuel is introduced thereinto;

electrical means for igniting said ignition spray of fuel to thereby produce a pilot flame in said ignition chamber; and piston means for applying pressure on said charge of gelled fuel to force the charge when said valve is in its discharge position through said second aperture pattern, the rate and pressure of said piston means being such that the charge is broken up by passage through said second aperture pattern into a discrete cloud of particles of gelled fuel having sufficient momentum to travel through the ignition chamber where said cloud is ignited, said momentum carrying the ignited cloud out of said dispenser and away from said vehicle.

* * * * *